US006866268B2

(12) United States Patent
Christianson

(10) Patent No.: US 6,866,268 B2
(45) Date of Patent: Mar. 15, 2005

(54) DISK TOSSING GAME AND DISKS THEREFOR

(76) Inventor: Nels M. Christianson, 1725 18th Ave. SE., Olympia, WA (US) 98501

( * ) Notice: Subject to any disclaimer, the term of this patent is extended or adjusted under 35 U.S.C. 154(b) by 0 days.

(21) Appl. No.: 10/435,840

(22) Filed: May 12, 2003

(65) Prior Publication Data

US 2004/0227284 A1 Nov. 18, 2004

(51) Int. Cl.[7] ..... A63B 67/06

(52) U.S. Cl. ..... 273/401; 273/398; 273/400; 273/402; 273/DIG. 26

(58) Field of Search ..... 273/398, 400, 273/401, 402, 287, 126 R, DIG. 26

(56) References Cited

U.S. PATENT DOCUMENTS

| | | | | | |
|---|---|---|---|---|---|
| 61,960 | A | * | 2/1867 | Spofford et al. | 273/386 |
| 742,416 | A | * | 10/1903 | Hall | 273/398 |
| 922,717 | A | | 5/1909 | Parker | |
| 3,628,793 | A | | 12/1971 | Mudloff | |
| 4,877,256 | A | * | 10/1989 | Falloon | 273/400 |
| 4,927,161 | A | * | 5/1990 | Brenneman | 273/402 |
| 4,936,590 | A | | 6/1990 | Palmer | |
| 5,056,796 | A | | 10/1991 | Conville | |
| 5,201,527 | A | | 4/1993 | Koket | |
| 5,286,034 | A | | 2/1994 | Haverkate et al. | |
| 5,382,028 | A | * | 1/1995 | Sciandra et al. | 273/401 |
| 5,553,862 | A | * | 9/1996 | Konotopsky | 273/402 |
| 5,575,480 | A | | 11/1996 | Wehr | |
| 5,755,439 | A | * | 5/1998 | Turner | 273/126 R |
| 5,776,021 | A | | 7/1998 | Rakonjac | |
| 6,161,833 | A | | 12/2000 | Gomez | |
| 6,296,249 | B1 | | 10/2001 | Mogensen | |
| 6,341,780 | B1 | | 1/2002 | Pant et al. | |
| 6,464,226 | B1 | | 10/2002 | Kephart | |

* cited by examiner

*Primary Examiner*—Raleigh W. Chiu
(74) *Attorney, Agent, or Firm*—Polly L Oliver

(57) ABSTRACT

A tossing game with apparatus and an accompanying method of play, the apparatus comprising a target surface, a plurality of tossing disks, and a scoring peg. The game offers opportunity for variety and strategy of play by allowing for a multiplicity of games with the same apparatus, thereby increasing the enjoyment of the participants. In the preferred method of play, each player tosses three rings onto the target surface. The toss is scored according to the landing position of the rings and the scoring position of the "power key." The first player to reach a predetermined score without faulting wins.

11 Claims, 2 Drawing Sheets

DISK TOSSING GAME AND DISKS THEREFOR

FIELD OF THE INVENTION

This invention pertains generally to tossing games and more specifically to a tossing game for tossing disks onto a target board.

BACKGROUND OF THE INVENTION

Tossing games have existed for many years. They are used not only for recreation and enjoyment, but also to improve throwing and targeting skills. There are several disk tossing games in the prior art, many of which are derivations of an original game often referred to as Washoes, a game in which the players throw disks into bores or holes on a target board.

For instance, U.S. Pat. No. 6,341,780 to Pant et al. discloses a game whereby a player tosses a number of disks into holes on a target board, the board having scoring indicia adjacent to the holes. While taking his turn, the player stands on a second board facing the target board. Because the scoring indicia are fixed onto the board relative to the holes, however, the Pant game does not allow for much variation in the method of play or the strategies therefor.

Another extant patent, U.S. Pat. No. 6,296,249 to Mogensen, discloses a disk tossing game, the target board of which is provided with various surface features, including a low coefficient of friction between the board surface and the disks to improve the sliding characteristics of the disks. Mogensens's patent neither claims nor discloses any methods or rules of play, thereby omitting any strategic advances of the game.

SUMMARY OF THE INVENTION

The present invention solves the above-mentioned problems by providing a disk tossing game that provides a more complex and challenging method of play. One aspect of the invention comprises a target board, a scoring peg, and a plurality of tossing disks. The target board is substantially rectangular in shape and is oriented generally horizontally so that it has a top surface defining three target holes sized to admit one or more disks therethrough. (The top surface and the target holes are generally symmetrical about a longitudinal centerline.) In order to allow the disks to pass through the top surface target holes, it is necessary that the top surface be raised from the ground (or other surface), and this is done in the preferred embodiment by providing two side rails and two end rails depending from the top surface.

The scoring peg, sometimes referred to as the "power key" can be moved among three different scoring receptacles, one corresponding to each target hole on the top surface. Although the scoring receptacles need be on only one of the side rails, in the preferred embodiment in order to maintain symmetry and provide more options for play, such receptacles are disposed on both of the side rails depending from the top surface, and there is a ring-like handle on one end of the power key to facilitate its manipulation therebetween.

The tossing disks, referred to herein as "rings" or "tossing rings" due to their torical shape, are specifically designed to enhance their flight characteristics and to improve the friction interaction between rings and top surface. Additionally, the tossing rings may include inserts or markings thereon, designating one of each set as the "power ring," thereby further increasing the possibilities for scoring variations and complexity of play.

A player's "turn" includes tossing a set of three rings, one of which is marked as the "power ring," toward the target holes from behind a throw line. In the preferred method of play, the power key will have been inserted into a chosen scoring receptacle prior to play. The player's turn is then scored according to the landing position of the rings and the position of the power key. In the preferred method of scoring, any ring landing in the target hole nearest the throw line scores 1 point. A ring in the middle target hole scores 3 points, and a ring in the farthest target hole scores 5 points. If both players have a ring in the same target hole, the rings cancel each other, and neither player scores. If the power key is located at the same target hole (i.e., in the receptacle corresponding to that target hole) in which a power ring has landed, that player receives double the normal points for that ring.

If a player's score exceeds 21 points, the player is penalized by subtracting the number of points scored in that turn from the score with which the player started that turn. For example, player A has 19 points and scores 5 points for the turn. Because his score would exceed 21, he must subtract 5 from 19 and begin the next turn with 14 points.

The winner is the first player to have a score of exactly 21 at the end of his turn. This means that a player must throw and score all three rings in each turn, even if he has already reached 21 with the first or second ring. Special rules apply if a player finds himself in the position of having already reached 21 but still having rings to toss. He must toss the remaining rings, and if a ring comes to rest off of the top surface, the player receives 0 points for that turn. If a ring comes to rest in a target hole, and an opponent's ring is already in the target hole, then the hole score will be counted as though the ring landed off of the top surface, and the player will receive 0 points for that turn.

DETAILED DESCRIPTION OF THE PREFERRED EMBODIMENTS

Figure 1:
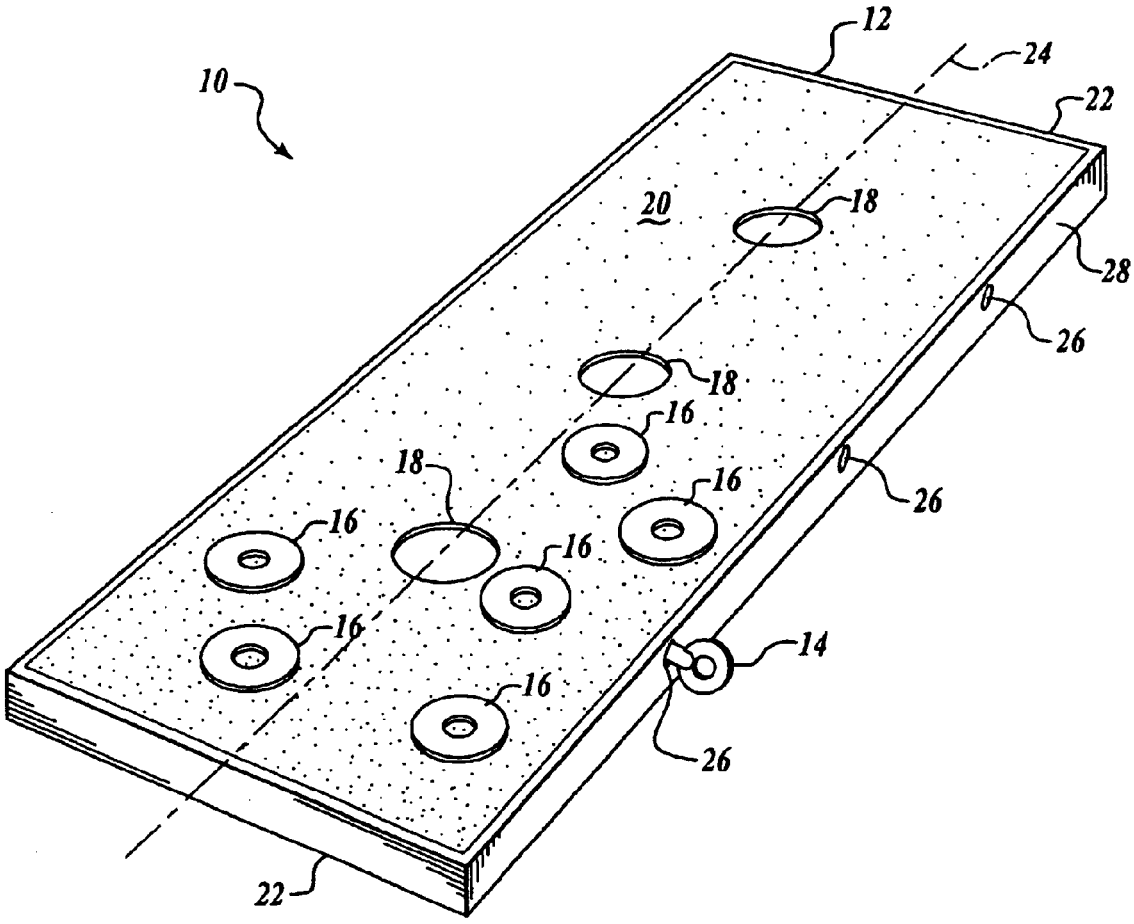
FIG. 1 is a perspective view of the preferred embodiment of the game, showing the target board, two sets of tossing rings, and the power key within one of the scoring receptacles.

FIG. 1 shows the apparatus for the game 10, including a target board 12, the power key (scoring peg) 14, and six tossing rings (tossing disks) 16 (two sets). The three target holes 18 on the top surface 20 of the target board 12 are arranged so that they are approximately evenly spaced from the two ends 22 of the target board 12 and are symmetrical about the centerline 24. In the preferred embodiment, the top surface 20 of the target board 12 measures approximately 48 inches long by 18 inches wide and is textured so as to improve friction characteristics between the surface 20 and the rings 16. Also in the preferred embodiment, the target holes 18 are approximately 4 inches in diameter.

Figure 2:
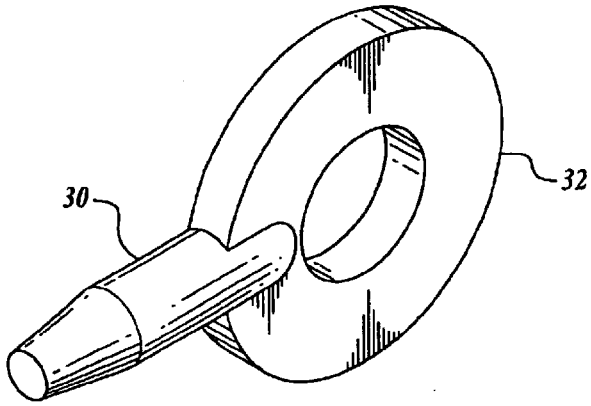
FIG. 2 is perspective view of the power key.

FIG. 1 also shows the power key 14 inserted into one of the scoring receptacles 26. There are three scoring receptacles 26, adapted to receive the power key 14, arranged along the side rail 28 so as to correspond to the holes 18 on the top surface 20. (In the preferred embodiment, there are also three corresponding scoring receptacles in the opposite side rail—not shown.) The power key 14 of the preferred embodiment, as shown in perspective view in FIG. 2, comprises a peg 30 and a handle 32. The peg 30 of the preferred embodiment is fashioned from a generally cylindrical dowel and sized and tapered to fit within the scoring receptacles 26. The handle 32 could take many different forms, but for aesthetic purposes in the preferred embodiment, approximates the ring design of the tossing rings 16. The power key 14 need not be constructed of two separate elements fixed together; it could be made as a single piece (e.g., by injection molding).

Figure 3A:
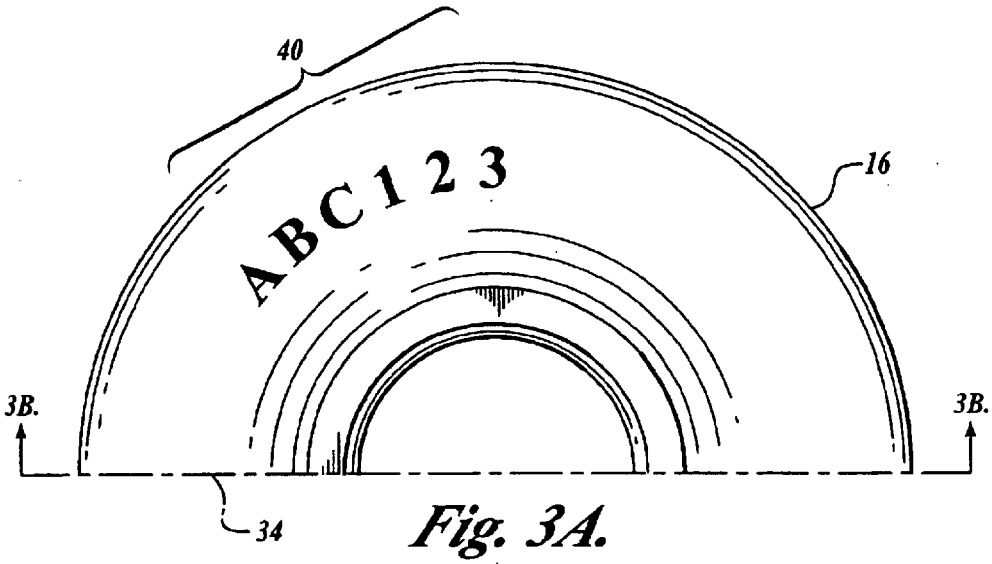
FIG. 3A is a plan view of one of the tossing rings showing the optional markings thereon.
Figure 3B:
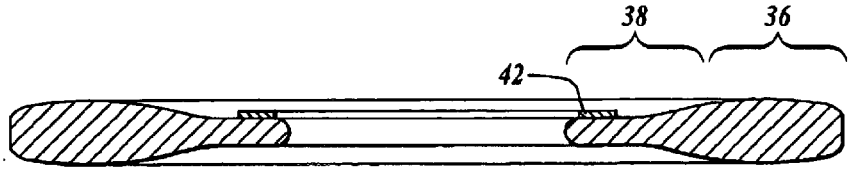
FIG. 3B is a cross-sectional view of the ring showing the optional insert thereon.

FIG. 3A is a plan view of a ring 16 showing the torical shape. Only half of the ring 16 is shown; it is understood that the ring 16 is symmetrical about the centerline 34 and has a geometric center. The optional markings 40 on the outer surface of the ring are applied to identify each player's rings—usually three per player. FIG. 3B is a sectional view of the ring 16 of FIG. 3A taken at the centerline 34 and showing how the ring of the preferred embodiment is weighted towards the outer periphery. The outer, thicker portion 36 tapers gently into the inner, thinner portion 38, providing for improved aerodynamic characteristics of the ring 16. Instead of, or in addition to, the markings 40, the optional insert 42 is shown as it may be applied to the inner portion 38 of the ring 16. In the preferred embodiment, such insert 42 does not protrude beyond the maximum thickness limit of the outer portion 36. In alternate embodiments, the outer surface of the ring 16 may be textured so as to increase or decrease the friction between the rings 16 and the top surface 20, thereby increasing the difficulty of the game 10.

What is claimed is:

1. A tossing game comprising:

a generally horizontal target board, such board being substantially rectangular in shape with a longitudinal centerline across which the board is generally symmetrical and having a top surface with three holes disposed thereon, such holes being generally centrally aligned along the longitudinal centerline and being sized to admit one or more tossing disks, such board also including two longitudinal side rails depending from the top surface and two end rails also depending from the top surface, at least one longitudinal side rail defining three scoring receptacles, such receptacles corresponding one-to-one with the holes and being adapted to receive a scoring peg; and a scoring peg, such scoring peg being generally cylindrical in shape and adapted to fit within the scoring receptacles on the side rail, such peg also comprising a handle; and a plurality of tossing disks, each disk being substantially torical in shape and having an outer periphery, each disk also being weighted towards said outer periphery and sized and adapted to fit through the holes on the target board.

2. The game of claim 1 wherein the top surface of the target board is textured so as to improve friction characteristics between the top surface and the tossing disks.

3. The game of claim 1 wherein the top surface further includes a textured covering so as to improve friction characteristics between the top surface and the tossing disks.

4. The game of claim 1 wherein the scoring peg is fashioned from a generally cylindrical dowel and is tapered to fit within the scoring receptacles on the side rail of the target board.

5. The game of claim 4 wherein the handle of the scoring peg is generally torical in shape, in order to aesthetically match the tossing disks, and is fixedly attached to the dowel.

6. A method of playing a tossing game, such game comprising a generally horizontal target board having three holes disposed thereon and a side rail having three scoring receptacles, said receptacles corresponding one-to-one with said three holes, a plurality of weighted tossing disks adapted to fit through the holes, and a scoring peg adapted to fit within the scoring receptacles, comprising the steps of:

establishing a throw line and setting up the target board a predetermined distance from the throw line and oriented generally orthogonally thereto so that the holes are located at varying distances from the throw line;

inserting the scoring peg into one of the scoring receptacles, said scoring receptacles to be chosen according to the agreed rules and intended to make the game more challenging;

tossing the weighted tossing disks toward the target board and thereby attempting to place them through the holes; and scoring the game according to agreed rules.

7. The method of claim 6 wherein the game further comprises two players who play in turn, each player being provided with three tossing disks, such disks comprising identifying markings thereon, and one player's turn comprises tossing the three disks and determining the player's score according to the agreed rules, said agreed rules for determining a player's score comprising scoring 1 point for a disk in the hole closest to the throw line, 3 points for a disk an the hole intermediate from the throw line, and 5 points for a disk in the hole farthest from the throw line and scoring double points for a disk in a hole corresponding to the position of the scoring peg.

8. The method of claim 7 wherein the identifying markings on the disks identify one disk as the power ring and the play alternates between the two players, and each player endeavors to reach, without exceeding, a score of 21.

9. The method of claim 8 wherein the agreed rules further comprise that if the power ring lands in the same target hole at which the scoring key is located, then that player receives double the normal points for that ring, and if a player's score exceeds 21 points at the end of his turn, then the player is penalized by subtracting the number of points scored in that turn from the score with which the player started that turn.

10. The method of claim 9 wherein the agreed rules further comprise that if a player reaches a score of 21 before the end of his turn, and the player tosses another disk which lands in an empty target hole, then that hole score will be counted against the player's score.

11. The method of claim 10 wherein the agreed rules further comprise that if a player reaches a score of 21 before the end of his turn, and the player tosses another disk which lands in a target hole in which the opponent's disk already rests, then the hole score will be zero for that turn.

* * * * *